US011141870B1

(12) United States Patent
Goldstein

(10) Patent No.: US 11,141,870 B1
(45) Date of Patent: Oct. 12, 2021

(54) CLIPS FOR MULTI-PURPOSE TOOLS

(71) Applicant: Avraham Goldstein, Flushing, NY (US)

(72) Inventor: Avraham Goldstein, Flushing, NY (US)

( * ) Notice: Subject to any disclaimer, the term of this patent is extended or adjusted under 35 U.S.C. 154(b) by 48 days.

(21) Appl. No.: 16/449,351

(22) Filed: Jun. 22, 2019

(51) Int. Cl.
*B26B 1/10* (2006.01)
*B26B 29/02* (2006.01)
*B26B 11/00* (2006.01)

(52) U.S. Cl.
CPC ..... *B26B 1/10* (2013.01); *B26B 29/02* (2013.01); *B26B 11/001* (2013.01)

(58) Field of Classification Search
CPC ..... B26B 11/00–008; B26B 1/00–10
USPC ..... 30/151–162; D8/394, 395
See application file for complete search history.

(56) References Cited

U.S. PATENT DOCUMENTS 3,209,968 A * 10/1965 Flanagan ..... A45F 5/02 224/255
4,172,543 A * 10/1979 Fischer ..... A45F 5/02 224/268
4,190,955 A * 3/1980 Rushforth ..... A63B 57/0037 224/666
5,029,354 A * 7/1991 Boyd, Jr. ..... B26B 1/048 30/161
5,038,985 A * 8/1991 Chapin ..... A47F 7/143 224/669
5,331,721 A * 7/1994 Raum, Sr. ..... A44B 99/00 224/269
5,349,753 A * 9/1994 Gaffney ..... B26B 1/00 30/155
5,495,673 A * 3/1996 Gardiner ..... B26B 11/00 30/155
5,572,793 A * 11/1996 Collins ..... B26B 3/06 30/155
5,704,129 A * 1/1998 Glesser ..... B26B 1/02 30/155
5,815,927 A * 10/1998 Collins ..... B26B 1/046 30/161
6,397,477 B1 * 6/2002 Collins ..... B26B 1/042 30/155
6,470,535 B1 * 10/2002 Mayne ..... A45F 5/02 224/197
6,688,505 B1 * 2/2004 Bradley ..... A45F 5/02 224/194
D487,628 S * 3/2004 Mathews ..... D3/215
(Continued)

FOREIGN PATENT DOCUMENTS

JP 02102905 A * 4/1990 ..... F16B 2/20
JP 2004144645 A * 5/2004 ..... G01B 3/10
WO WO-9525445 A1 * 9/1995 ..... A41F 9/007

*Primary Examiner* — Jason Daniel Prone

(57) ABSTRACT

A clip that is configured to be reversibly attached to a multi-purpose tool is disclosed. The clip includes a body that has a top area and a bottom area. The bottom area includes a concave section that is configured to contact a person wearing the clip and to facilitate immobilizing the clip on the person. The top area includes a loop formed by two parallel and integrally connected sides, with a space located between the two parallel and integrally connected sides being configured to receive a portion of the person's clothing. The top area further includes an attachment means that is configured to reversibly connect the clip to a key ring hole of the multi-purpose tool.

6 Claims, 4 Drawing Sheets

(56) References Cited

U.S. PATENT DOCUMENTS 7,110,802 B1 * 9/2006 Kim ..... H04B 1/3888 224/269
D530,192 S * 10/2006 Becerra ..... D8/395
D570,247 S * 6/2008 Hajianpour ..... D11/201
D597,827 S * 8/2009 Brassard ..... D8/395
7,574,804 B2 * 8/2009 Bezold ..... B26B 1/08 30/151
7,966,700 B2 * 6/2011 Vermillion ..... A45F 5/02 24/3.12
8,028,873 B2 * 10/2011 Hawk ..... A45F 5/022 224/269
8,291,597 B2 * 10/2012 Hawk ..... B26B 1/048 30/155
8,413,338 B2 * 4/2013 Freeman ..... B26B 1/048 30/159
8,893,389 B2 * 11/2014 Freeman ..... B26B 1/046 30/155
8,939,054 B2 * 1/2015 Hawk ..... B26B 1/04 30/151
9,289,903 B1 * 3/2016 Douzanis ..... B26B 1/10
9,451,821 B1 * 9/2016 Estigoy ..... A45F 3/005
10,070,713 B1 * 9/2018 Carver ..... A45F 5/022
10,478,976 B2 * 11/2019 Liang ..... B26B 1/10
D891,239 S * 7/2020 Goldstein ..... D8/395
10,786,070 B1 * 9/2020 Young ..... B26B 1/10
2002/0066187 A1 * 6/2002 Jennings ..... B26B 1/044 30/161
2006/0080842 A1 * 4/2006 Schmidt ..... B26B 5/003 30/162
2009/0144986 A1 * 6/2009 Frazer ..... B26B 1/048 30/159
2012/0180321 A1 * 7/2012 MacNair ..... B26B 1/044 30/161
2016/0207207 A1 * 7/2016 Tom ..... B26B 1/048
2019/0077032 A1 * 3/2019 Squiers ..... B26B 1/046
2019/0224860 A1 * 7/2019 Alexander ..... B26B 1/04
2019/0366567 A1 * 12/2019 Mitchell ..... B26B 1/02

* cited by examiner

CLIPS FOR MULTI-PURPOSE TOOLS

FIELD OF THE INVENTION

The field of the present invention relates to clips for multi-purpose tools and, more particularly, to clips that are adapted to be reversibly attached to a multi-purpose tool, which can then be worn on a person's belt, pocket, or other areas of the person.

BACKGROUND OF THE INVENTION

Multi-purpose tools, such as the famous Swiss Army Knife, are routinely carried by various members of the public. Such tools often include blades, screwdrivers, and can openers, which can be stowed within the handle of the tools (when not being used) and then pulled out of the handle through a pivot point (when being deployed for use). The tools are often carried in a person's pocket; however, the weight of the tool—when loosely carried in a pocket—can sometimes create discomfort for the person (or is not otherwise feasible if a person is not wearing adequately sized pockets). As such, it would be preferred to provide a lightweight and easy-to-use device that would facilitate carrying such multi-purpose tools, without having to carry the tool loosely within a pocket.

As the following will demonstrate, the present invention addresses the foregoing needs (and others) in the marketplace.

SUMMARY OF THE INVENTION

According to certain aspects of the present invention, clips that are configured to be reversibly attached to a multi-purpose tool are provided. The invention provides that the clips include a body that has a top area and a bottom area. The bottom area includes a concave section that is configured to contact a person wearing the clip (and to facilitate immobilizing the clip on the person). The invention provides that the top area includes a loop formed by two integrally connected and contiguous sides, with a space located between the two integrally connected and contiguous sides being configured to receive (and be inserted onto) a portion of the person's clothing (e.g., the belt or pocket seam being worn by a person). The top area further includes an attachment means, as described further herein, which is configured to reversibly connect the clip to a key ring hole of the multi-purpose tool.

According to additional aspects of the invention, combinations of the clips and multi-purpose tools are provided, e.g., when such combinations are packaged and sold together.

The above-mentioned and additional features of the present invention are further illustrated in the Detailed Description contained herein.

DETAILED DESCRIPTION OF THE INVENTION

The following will describe, in detail, several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used and made without departing from the scope and spirit of the invention.

Figure 1:
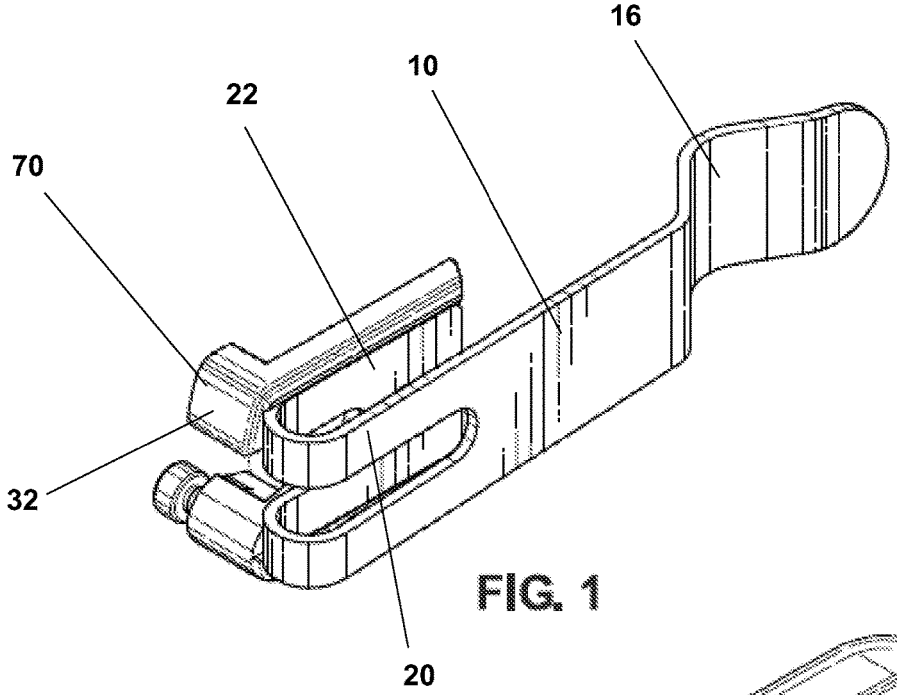
FIG. 1 is an elevated perspective view of a clip of the present invention.
Figure 2:
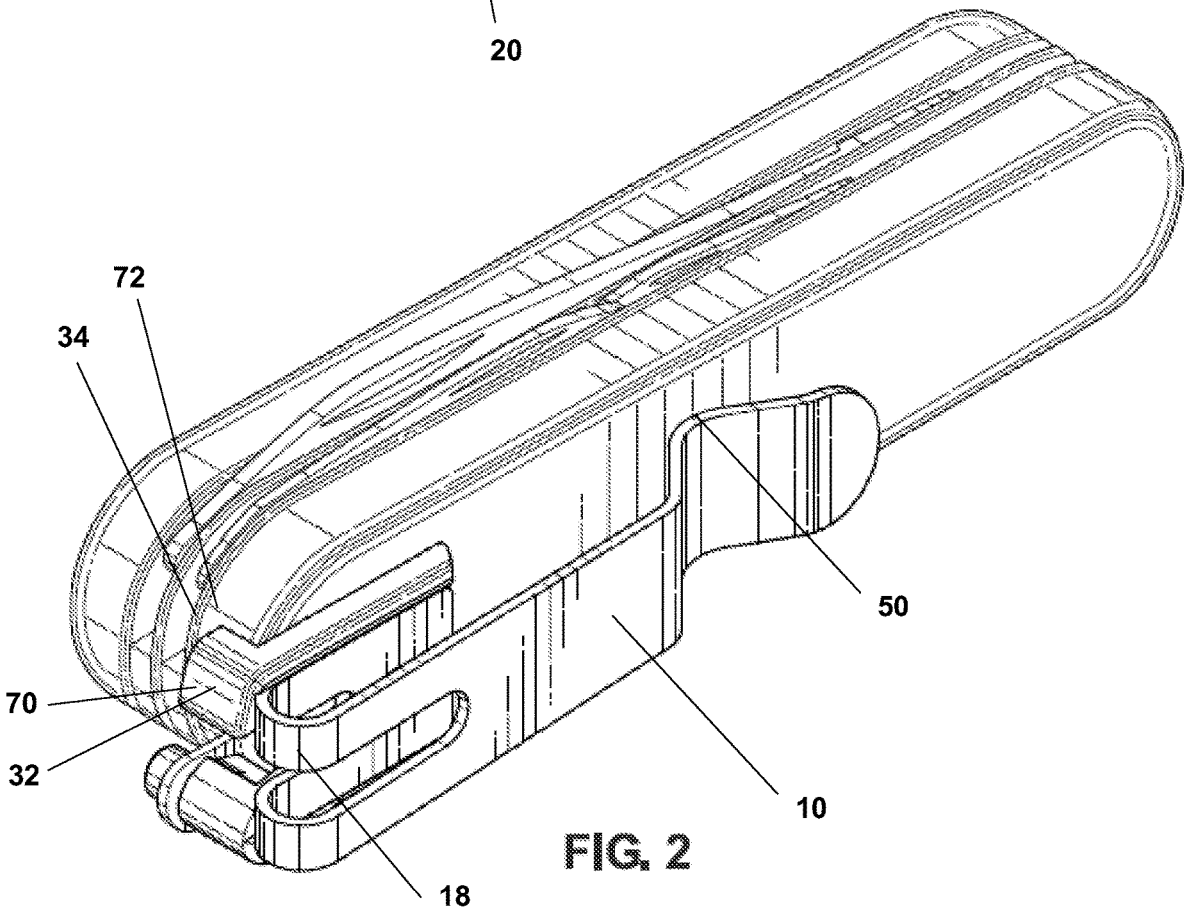
FIG. 2 is an elevated perspective view of a clip of the present invention, shown to be attached to a multi-purpose tool.
Figure 3:
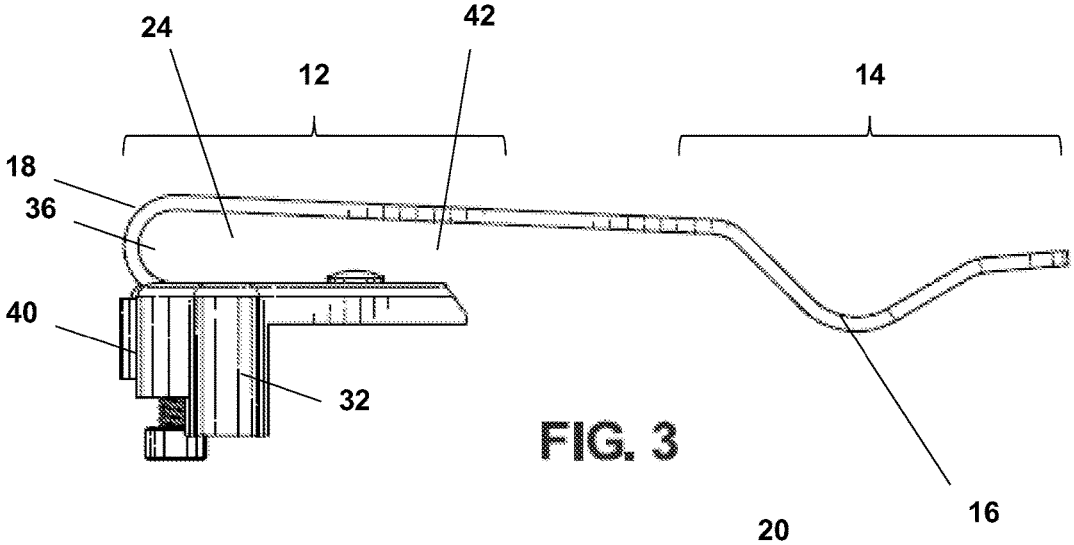
FIG. 3 is a right side view of a clip of the present invention.
Figure 4:
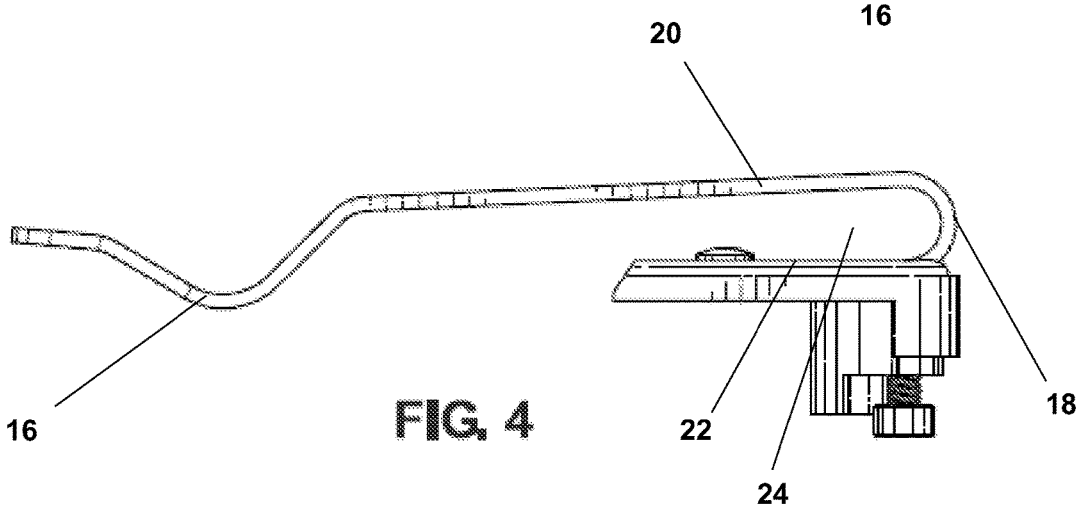
FIG. 4 is a left side view of a clip of the present invention.
Figure 5:
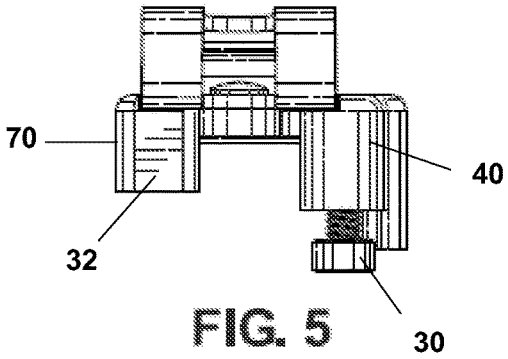
FIG. 5 is a top side view of a clip of the present invention.
Figure 6:
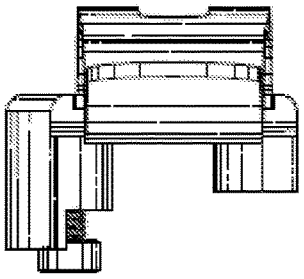
FIG. 6 is a bottom side view of a clip of the present invention.

Referring now to FIGS. 1-9, according to certain preferred embodiments of the present invention, clips that are configured to be reversibly attached to a multi-purpose tool are provided. In certain embodiments, the invention provides that the clip includes a body 10 that has a top area 12 and a bottom area 14 (FIG. 3). The bottom area 14 includes a concave (i.e., curved) section 16 that is configured to contact a person wearing the clip (and to facilitate immobilizing the clip on the person). More particularly, the invention provides that the concave section 16 is configured to exert a force on a person's clothing, e.g., around area 50 in FIG. 2, when the clip is being worn by a person such that clothing is tightly positioned between the concave section 16 and body of the multi-purpose tool (around area 50).

According to certain preferred embodiments, the invention provides that the top area 12 includes a loop 18 formed by two integrally connected and contiguous sides 20,22 (FIGS. 1 and 4), with a space 24 located between the two integrally connected sides 20,22 being configured to receive a portion of the person's clothing (e.g., the belt or pocket seam being worn by a person). The invention provides that the two integrally connected sides 20,22 may be positioned to rest parallel to each other or, more preferably, slightly less than parallel. More specifically, when the sides 20,22 are configured to rest slightly less than parallel to each other, the space 24 formed between the two sides 20,22 is slightly greater in an area 36 (closest to the top side 40 of the clip, when viewed from the side), compared to an opposite area 42 that is further from the top side 40 of the clip (FIG. 3). The invention provides that such configuration enhances the ability of the clip to be immobilized to a person's clothing.

Figure 9:
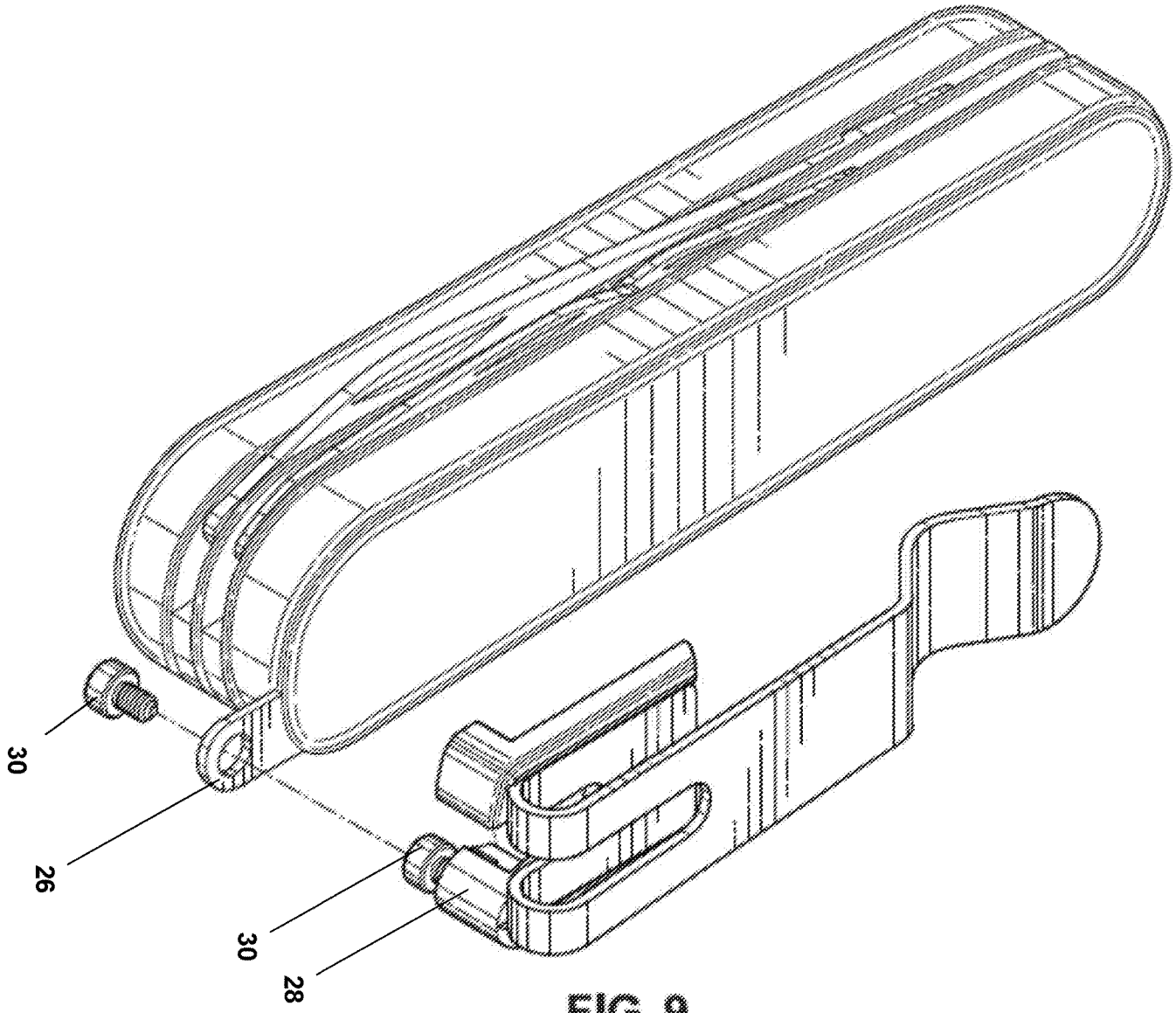
FIG. 9 is a perspective view of a clip of the present invention, prior to being attached to a multi-purpose tool.

The top area 12 further includes an attachment means, which is configured to reversibly connect the clip to a key ring hole 26 of the multi-purpose tool (FIG. 9). According to certain preferred embodiments, the invention provides that the attachment means will include a threaded aperture 28 and a screw 30, with the shaft of the screw 30 being configured to be inserted through the key ring hole 26 of the multi-purpose tool and into the threaded aperture 28 (FIG. 9). As such, the screw 30 is configured to be rotated and tightened to reversibly attach the clip to the multi-purpose tool. In other embodiments, the invention provides that the attachment means may consist of a pin, magnetic elements, or other mechanical means to reversibly connect the clip to the key ring hole 26 of the multi-purpose tool.

In addition, according to certain preferred embodiments, the invention provides that the top area 12 further includes a protruding cap 32 that is positioned and configured to nestably reside adjacent to a top side 34 of the multi-purpose tool (FIG. 2). According to such embodiments, the surface of the protruding cap 32 that is positioned and configured to nestably reside adjacent to the top side 34 of the multi-purpose tool will preferably exhibit a dimension that is complementary to the top side 34 of the multi-purpose tool. For example, in the embodiments shown in FIG. 2, the top side 34 of the multi-purpose tool is slightly curved. As such, the surface 70 of the protruding cap 32 that is positioned and configured to nestably reside adjacent to the curved top side 34/72 of the multi-purpose tool will preferably exhibit a complimentary curved dimension, which allows the protruding cap 32 to nestably reside adjacent to the top side 34 of the multi-purpose tool. The invention provides that the protruding cap 32, when configured as described herein, further enables the clip to securely hold the multi-purpose tool.

The invention provides that the clips of the present invention may comprise and be manufactured from stainless steel, other metals and alloys, plastics, combinations of the foregoing, and/or other suitably rigid materials. In addition, the invention provides that various manufacturing methods could be used to construct the clips of the present invention, such as 3D printing, CNC machining, polymer casting, rotational molding, vacuum forming, injection molding, extrusion, pressing, blow molding, forging, and/or other methods.

Figure 7:
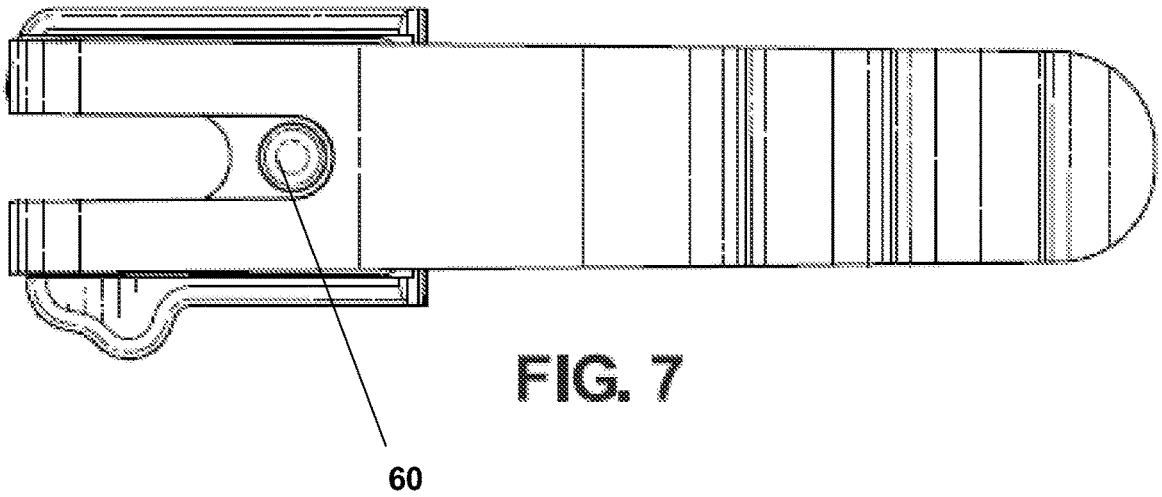
FIG. 7 is a back side view of a clip of the present invention.
Figure 8:
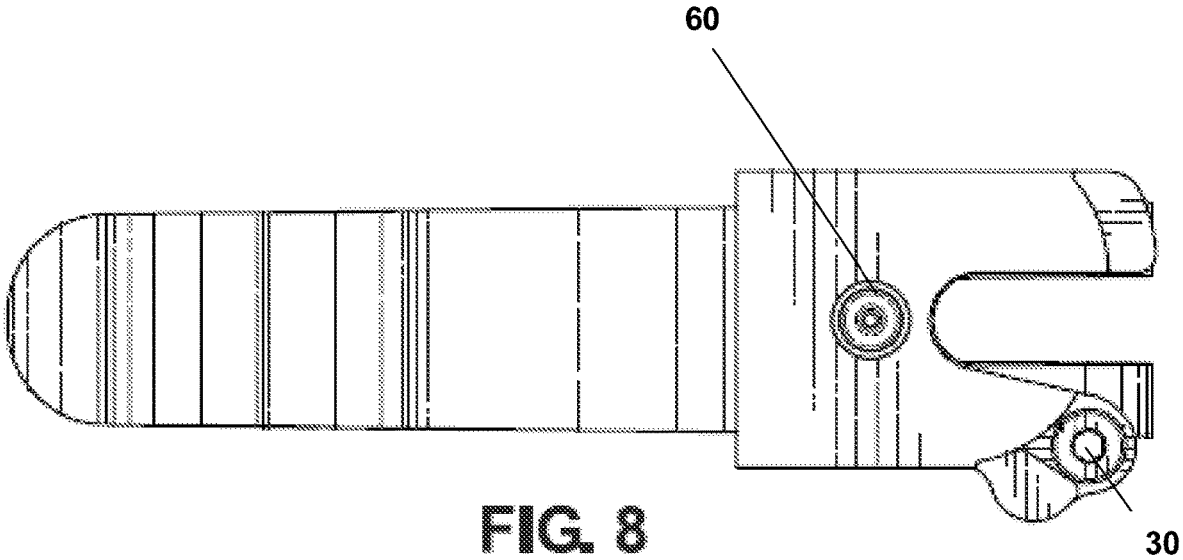
FIG. 8 is a front side view of a clip of the present invention.

The invention provides that the clip may, optionally, be manufactured from a single and integrally connected piece of material. Alternatively, the invention provides that the clip may, optionally, be manufactured to initially consist of two separate pieces, which are subsequently connected to each other through suitable means, e.g., screws, rivets, welding, adhesives, etc. This latter approach for manufacturing the clips can be advantageous, insofar as it renders manufacturing the two (initially) separate pieces less complex (which can reduce the expense of manufacturing). For example, in the embodiments shown in FIGS. 1-9, a first piece may be manufactured to consist of the body 10, which includes the concave (i.e., curved) section 16, the sides 20,22, and loop 18—while a second piece may be manufactured to consist of the protruding cap 32, threaded aperture 28, and screw 30. The first and second piece may then be permanently connected to each other via welding or other mechanical means, such as a rivet 60 (FIGS. 7 and 8).

According to yet further embodiments of the present invention, combinations of the clips and multi-purpose tools, e.g., when such combinations are packaged and sold together, are encompassed by the present invention. That is, the invention encompasses the clips being manufactured and sold separately or, in other embodiments, the invention encompasses the clips being packaged and sold along with a suitably configured multi-purpose tool described herein.

The many aspects and benefits of the invention are apparent from the detailed description, and thus, it is intended for the following claims to cover all such aspects and benefits of the invention which fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A clip that is configured to be attached to a multi-purpose tool with a first end including a key ring hole and a curved surface, wherein the clip comprises a body that includes a first area and a second area, wherein:

(a) the second area includes a concave section that is configured to contact a person wearing the clip and to facilitate immobilizing the clip on the person;

(b) the first area includes a loop formed by two integrally connected sides, wherein a space located between the two integrally connected sides is configured to receive a portion of the person's clothing, wherein a first one of the integrally connected sides within the first area is connected to an attachment means that is configured to connect the clip to the key ring hole of the multi-purpose tool, wherein the attachment means protrudes away from the space located between the two integrally connected sides; and (c) the first one of the integrally connected sides is connected to a protruding cap, which (i) is oriented to protrude away from the space located between the two integrally connected sides; and (ii) includes a curved surface configured to cooperate with the curved surface of the multi-purpose tool to allow for the protruding cap to nestably reside adjacent to the first end of the multi-purpose tool.

2. The clip of claim 1, wherein the attachment means includes a threaded aperture and a screw, wherein the screw is configured to be inserted through the key ring hole of the multi-purpose tool and into the threaded aperture, whereupon the screw is configured to be tightened to attach the clip to the multi-purpose tool.

3. The clip of claim 1, wherein the two integrally connected sides are configured to rest less than parallel to each other, such that the space located between the two integrally connected sides is greater in an area closest to a top side of the clip, compared to an opposite area of the space that is further from the top side of the clip.

4. A clip and a multi-purpose tool combination, wherein the multi-purpose tool comprises a first end including a key ring hole and a curved surface, wherein the clip comprises a body that includes a first area and a second area, wherein:

(a) the second area includes a concave section that is configured to contact a person wearing the clip and to facilitate immobilizing the clip on the person;

(b) the first area includes a loop formed by two integrally connected sides, wherein a space located between the two integrally connected sides is configured to receive a portion of the person's clothing, wherein a first one of the integrally connected sides within the first area is connected to an attachment means that is configured to connect the clip to the key ring hole of the multi-purpose tool, wherein the attachment means protrudes away from the space located between the two integrally connected sides; and (c) the first one of the integrally connected sides is connected to a protruding cap, which (i) is oriented to protrude away from the space located between the two integrally connected sides; and (ii) includes a curved surface configured to cooperate with the curved surface of the multi-purpose tool to allow for the protruding cap to nestably reside adjacent to the first end of the multi-purpose tool.

5. The clip and multi-purpose tool combination of claim 4, wherein the attachment means includes a threaded aperture and a screw, wherein the screw is configured to be inserted through the key ring hole of the multi-purpose tool and into the threaded aperture, whereupon the screw is configured to be tightened to attach the clip to the multi-purpose tool.

6. The clip and multi-purpose tool combination of claim 5, wherein the two integrally connected sides are configured to rest less than parallel to each other, such that the space located between the two integrally connected sides is greater in an area closest to a top side of the clip, compared to an opposite area of the space that is further from the top side of the clip.

* * * * *